US010132486B2

(12) United States Patent
Goldstein et al.

(10) Patent No.: US 10,132,486 B2
(45) Date of Patent: Nov. 20, 2018

(54) LED LAMP WITH AXIAL DIRECTED REFLECTOR

(71) Applicant: Cree, Inc., Durham, NC (US)

(72) Inventors: Corey Goldstein, Mt. Pleasant, WI (US); Kurt Wilcox, Libertyville, IL (US)

(73) Assignee: Cree, Inc., Durham, NC (US)

( * ) Notice: Subject to any disclaimer, the term of this patent is extended or adjusted under 35 U.S.C. 154(b) by 296 days.

(21) Appl. No.: 14/739,175

(22) Filed: Jun. 15, 2015

(65) Prior Publication Data

US 2016/0363307 A1 Dec. 15, 2016

(51) Int. Cl.

| | |
|---|---|
| ***F21V 7/00*** | (2006.01) |
| ***F21V 29/70*** | (2015.01) |
| ***F21V 7/04*** | (2006.01) |
| ***F21V 7/22*** | (2018.01) |
| ***F21V 29/77*** | (2015.01) |
| ***F21K 9/232*** | (2016.01) |
| *F21Y 101/00* | (2016.01) |

(52) U.S. Cl.

CPC ..... *F21V 29/70* (2015.01); *F21K 9/232* (2016.08); *F21V 7/041* (2013.01); *F21V 7/22* (2013.01); *F21V 29/773* (2015.01); *F21Y 2101/00* (2013.01)

(58) Field of Classification Search

CPC ..... F21V 7/00; F21V 7/0066; F21V 29/503; F21V 29/74; F21V 29/745; F21V 29/77; F21V 8/04; F21V 8/043; F21V 8/08; F21V 8/085; F21V 8/088

See application file for complete search history.

(56) References Cited

U.S. PATENT DOCUMENTS

| | | | | | |
|---|---|---|---|---|---|
| 592,660 | A * | 10/1897 | Miller | F16M 11/04 | 248/162.1 |
| 1,270,261 | A * | 6/1918 | Brueggeman | F21V 7/0025 | 362/302 |
| 2,185,694 | A * | 1/1940 | Noe | F21S 6/002 | 362/294 |
| 3,194,952 | A * | 7/1965 | Wells | F21S 8/088 | 181/141 |
| 3,215,831 | A * | 11/1965 | Gladsden et al. | F21S 8/088 | 174/45 R |
| 3,833,804 | A * | 9/1974 | Vesely | F21S 8/088 | 362/267 |
| 3,875,561 | A * | 4/1975 | Scarpino | B60Q 1/2611 | 340/472 |
| 3,961,174 | A * | 6/1976 | Blaylock | F21S 43/51 | 362/317 |
| 4,703,403 | A * | 10/1987 | Smith | F21S 8/081 | 362/268 |
| 5,134,550 | A * | 7/1992 | Young | F21S 8/088 | 362/298 |
| 6,183,100 | B1 * | 2/2001 | Suckow | B60Q 1/2611 | 257/E25.28 |

(Continued)

*Primary Examiner* — Ismael Negron

(74) *Attorney, Agent, or Firm* — Dennis J. Williamson; Moore & Van Allen PLLC

(57) ABSTRACT

A lamp includes at least one LED, an at least partially optically transmissive enclosure, a heat sink connected to the enclosure for dissipating heat from the LED, and a reflector for reflecting light along the longitudinal axis of the lamp either toward or away from the heat sink.

18 Claims, 7 Drawing Sheets

(56) References Cited

U.S. PATENT DOCUMENTS 6,932,496 B2 * 8/2005 Rizkin ..... B64F 1/205 362/183
7,213,940 B1 5/2007 Van De Ven et al.
7,568,817 B2 * 8/2009 Lee ..... F21K 9/00 362/294
7,607,803 B2 * 10/2009 Zhang ..... F21K 9/00 362/294
7,744,251 B2 * 6/2010 Liu ..... F21V 31/005 362/249.02
8,104,929 B2 * 1/2012 Kovalchick ..... F21S 8/088 362/235
8,262,258 B2 * 9/2012 VanderSluis ..... F21S 8/088 362/249.02
8,529,101 B2 * 9/2013 Chen ..... F21S 8/088 362/296.01
8,529,102 B2 * 9/2013 Pickard ..... F21V 7/0033 362/231
9,004,724 B2 * 4/2015 Gao ..... F21V 3/00 313/113
9,052,067 B2 * 6/2015 van de Ven ..... F21V 3/02
9,109,779 B2 * 8/2015 Roth ..... F21V 7/0016
9,234,638 B2 * 1/2016 Hussell ..... F21V 29/004
2003/0002286 A1 * 1/2003 Janover ..... F21V 1/16 362/351
2011/0273102 A1 11/2011 van de Ven et al.
2013/0026923 A1 1/2013 Athalye et al.
2013/0026925 A1 1/2013 Ven et al.
2013/0069535 A1 3/2013 Athalye
2013/0069547 A1 3/2013 van de Ven et al.
2013/0162149 A1 6/2013 van de Ven et al.
2013/0162153 A1 6/2013 van de Ven et al.
2013/0169159 A1 7/2013 Lys
2013/0293135 A1 11/2013 Hu et al.

* cited by examiner

LED LAMP WITH AXIAL DIRECTED REFLECTOR

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY

In some embodiments, a lamp for use in an existing light fixture comprises an at least partially optically transmissive enclosure. A LED assembly is located in the enclosure and operates to emit light when energized through an electrical path. A heat sink dissipates heat from the LED assembly where the heat sink is connected to the enclosure such that the lamp has a longitudinal axis that extends from the heat sink to the enclosure. A reflector is secured to the heat sink such that the reflector reflects light along the longitudinal axis of the lamp.

The reflector may be mounted over the enclosure and may have a reflective surface facing the heat sink. The reflector may be conical. The reflector may be formed by a circular flat member having a slit formed between the center of the flat member and the peripheral edge of the member. The slit may have a generally triangular shape defined by a first side edge and a second side edge where the first side edge and the second side edge may be connected together to form the conical reflector. The reflector may be made of thin aluminum. The reflector may be made of plastic. The reflector may be mounted on the heat sink using an upright. The upright may be secured to the heat sink using a deformable clamp. The deformable clamp may comprise a pair of opposed flanges that define a space therebetween where the space is dimensioned to receive a fin of the heat sink. The space between the opposed flanges may be slightly narrower than a thickness of the fin such that the flanges are deformed slightly away from one another when the fin is inserted between the flanges to create a clamping force on the fin. A plurality of uprights may be provided and a base plate may be secured to each of the plurality of uprights. The plate may have an annular shape defining an internal opening where the internal opening fits over the enclosure. The reflector may be mounted between the enclosure and the heat sink and may have a reflective surface facing away from the heat sink. The reflector may be mounted on the heat sink using an upright connected to a fin of heat sink. The reflector may be formed as an annular member having an inner aperture that receives a neck portion of the enclosure such that the enclosure extends through the reflector. The reflector may be supported directly on the enclosure such that the reflector is suspended from the enclosure. The reflector may be made of a first portion and a second portion that are connected together and surround the enclosure. The reflector may be made of a deformable material and may comprise a slit extending from the inner aperture to the outside edge of the reflector. The reflector may be mounted inside of the enclosure and may have a reflective surface facing the heat sink.

In some embodiments a light comprises an at least partially optically transmissive fixture. A LED lamp is located in the fixture. The LED lamp comprises an at least partially optically transmissive enclosure and a LED assembly located in the enclosure. The LEDs are operable to emit light when energized through an electrical path. A heat sink for dissipating heat from the LED assembly is connected to the enclosure such that the lamp has a longitudinal axis that extends from the heat sink to the enclosure. A base is in the electrical path. A reflector is secured to the heat sink such that the reflector reflects light along the longitudinal axis of the lamp. The LED lamp may be mounted in the fixture with the base above the enclosure or with the base below the enclosure.

In some embodiments a lamp comprises an at least partially optically transmissive enclosure. A LED assembly is located in the enclosure and is operable to emit light when energized through an electrical path to produce between approximately 2500 and 4500 Lumens. A heat sink for dissipating heat from the LED assembly is connected to the enclosure such that the lamp has a longitudinal axis that extends from the heat sink to the enclosure. A reflector is secured to the heat sink such that the reflector reflects light downwardly along the longitudinal axis of the lamp.

In some embodiments a light comprises an at least partially optically transmissive fixture. A LED lamp is mounted in the fixture in at least one of a base up orientation and a base down orientation. The LED lamp comprises an at least partially optically transmissive enclosure and a LED assembly comprising at least one LED located in the enclosure. The LED operable to emit light when energized through an electrical path. A heat sink dissipates heat from the LED assembly where the heat sink is connected to the enclosure such that the lamp has a longitudinal axis that extends from the heat sink to the enclosure. A base is in the electrical path. A first reflector is secured to the LED lamp in a first position when the lamp is in a base-up orientation and a second reflector secured to the LED lamp in a second position when the lamp is in a base-down orientation such that the first reflector and the second reflector reflect light downwardly along the longitudinal axis of the lamp.

DETAILED DESCRIPTION

Figure 1:
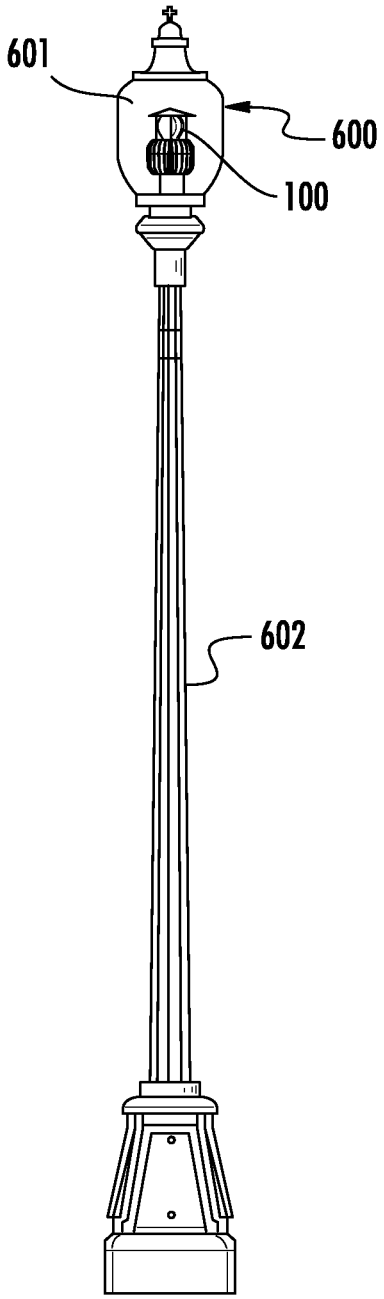
FIG. 1 is a front view of an embodiment of an Acorn light fixture with an embodiment of the lamp of the invention mounted on a light pole.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Lamps as described herein may be used in light fixtures such as "acorn" or "tear drop" lights. One embodiment of an acorn street light is shown in FIG. 1 and comprises an at least partially optically transmissive fixture 600 that includes an at least partially optically transmissive enclosure that may comprise an optically transmissive globe 601, such as a glass globe, that houses the lamp 100 of the invention. While lamp 100 is visible in FIG. 1, in some fixtures the globe 601 may be textured, frosted, coated or otherwise be diffusive such that the lamp 100 is not readily visible. The fixture 600 may be mounted on a lamp pole 602 for providing illumination such as along, paths, roads and the like. Traditionally, the globe 601 has the general shape of an acorn; however, the enclosure may have any suitable shape and size. In a typical acorn light an omnidirectional bulb having a screw connector is connected to an electrical receptacle such as a Mogul or medium socket such that the bulb is supported in the fixture and is electrically coupled to a power source. The lamp of the invention 100 may be used to replace a traditional incandescent bulb. While an embodiment of an acorn light fixture is shown and described herein, it is to be understood that the lamp of the invention may be used in a wide variety of lights, fixtures and the like. For example, a "tear drop" light may comprise a fixture mounted on a vertical pole at the end of a generally horizontal arm. The fixture hangs down from the arm such that the fixture is oriented downward as opposed to the upward orientation of the acorn fixture shown in FIG. 1. In a typical acorn style light the lamp 100 is mounted in a base-down orientation where the base of the lamp is below the optically transmissive enclosure. In a typical tear drop style light the lamp 100 is mounted in a base-up orientation where the base of the lamp 100 is above the optically trasnmissive enclosure. The lamp of the invention may be advantageously used in either a base-up or a base-down orientation.

Embodiments of a solid-state lamp are shown and described herein comprising a LED assembly 130 with light emitting LEDs 127. Multiple LEDs 127 can be used together, forming an LED array 128. The LEDs 127 in the LED array 128 may comprise an LED die disposed in an encapsulant such as silicone, and/or LEDs which are encapsulated with a phosphor to provide local wavelength conversion. A wide variety of LEDs and combinations of LEDs may be used in the LED assembly 130. The LEDs 127 of the LED array 128 are operable to emit light when energized through an electrical path. The term "electrical path" is used to refer to the electrical path to the LED's 127, and may include an intervening power supply, drivers and/or other lamp electronics, and includes the electrical connection between the electrical connector that provides power to the lamp and the LED array. The term may also be used to refer to the electrical connection between the power supply and the LEDs and between the electrical connector to the lamp and the power supply. Electrical conductors run between the LEDs 127 and the lamp base 102 to carry both sides of the supply to provide critical current to the LEDs 127 as will be described. The LEDs 127 may be mounted on a submount 129 that may form a part of the electrical path to the LEDs. In the present invention the term "submount" is used to refer to the support structure that supports the individual LEDs or LED packages and in may comprise a printed circuit board, metal core printed circuit board, lead frame extrusion, FR4 board, flex circuit or the like or combinations of such structures. The electrical path runs between the submount 129 and the electrical connector in the lamp base 102 to carry both sides of the supply to provide critical current to the LEDs 127.

In some embodiments, the submount 129 may be made of or comprise a thermally conductive material. The submount 129 may comprise a LED mounting portion that functions to mechanically support and electrically couple the LEDs 127 to the electrical path and a second connector portion that functions to provide thermal, electrical and/or mechanical connections to the LED assembly 130. The submount 129 may comprise a series of anodes and cathodes arranged in pairs for connection to the LEDs 127. The number of anode/cathode pairs and LEDs may vary. Moreover, more than one submount may be used to make a single LED assembly 130. Electrical connectors or conductors such as traces connect the anode from one pair to the cathode of the adjacent pair to provide the electrical path between the anode/cathode pairs during operation of the LED assembly 130. An LED or LED package containing at least one LED 127 is secured to each anode and cathode pair where the LED/LED package spans the anode and cathode. The LEDs/LED packages may be attached to the submount by soldering.

The LED assembly 130 may be contained in an optically transmissive enclosure 112 through which light emitted by the LEDs 127 is transmitted to the exterior of the lamp. The enclosure 112 may be entirely optically transmissive where the entire enclosure 112 defines the exit surface through which light is emitted from the lamp. The enclosure 112 may have a traditional bulb shape having a globe shaped main portion 114 that narrows to a neck 115. The enclosure 112 may be made of glass, quartz, borosilicate, silicate, polycarbonate, other plastic or other suitable material. In some embodiments, the exit surface of the enclosure may be coated on the inside with silica, providing a diffuse scattering layer that produces a more uniform far field pattern. The enclosure may also be etched, frosted or coated to provide the diffuser. In other embodiments the enclosure may be made of a material such as polycarbonate where the diffuser is created by the polycarbonate material. Alternatively, the surface treatment may be omitted and a clear enclosure may be provided. The enclosure may also be provided with a shatter proof or shatter resistant coating. It should also be noted that in this or any of the embodiments shown here, the optically transmissive enclosure or a portion of the optically transmissive enclosure could be coated or impregnated with phosphor.

LEDs and/or LED packages used with an embodiment of the invention can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference in its entirety.

The LED assembly 130 may be mounted to a heat sink 149 and an electrical interconnect 150 may provide the electrical connection between the LED assembly 130 and the lamp electronics 110. The heat sink structure 149 comprises a heat conducting portion 152 and a heat dissipating portion 154. The heat conducting portion 152 is also referred to herein as a "tower". In one embodiment the heat sink 149 is made as a one-piece member of a thermally conductive material such as aluminum, zinc or the like. The heat sink structure 149 may also be made of multiple components secured together to form the heat structure. Moreover, the heat sink 149 may be made of any thermally conductive material or combinations of thermally conductive materials.

The heat conducting portion 152 may be formed as a tower that is dimensioned and configured to make good thermal contact with the LED assembly 130 such that heat generated by the LED assembly 130 may be efficiently transferred to the heat sink 149. In one embodiment, the heat conducting portion 152 comprises a tower that extends along the longitudinal axis A-A of the lamp and extends into the center of the enclosure 112. The heat conducting portion 152 may comprise a generally cylindrical outer surface that matches the generally cylindrical internal surface of the LED assembly 130. The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. The heat dissipating portion 154 extends from the interior of the enclosure 112 to the exterior of the lamp 100 such that heat may be dissipated from the lamp to the ambient environment. A plurality of heat dissipating members 158 may be formed on the exposed portion to facilitate the heat transfer to the ambient environment. In one embodiment, the heat dissipating members 158 comprise a plurality of generally flat, thin, planar fins that extend outwardly and are aligned generally parallel to the longitudinal axis of the lamp A-A. The heat dissipating members 158 increase the surface area of the heat dissipating portion 154. The heat dissipating portion 154 and heat dissipating members 158 may have any suitable shape and configuration.

The LED assembly 130 may be mounted on the heat conducting portion 152 such that the LED array 128 is substantially in the center of the enclosure 112 such that the LED's 127 are positioned at the approximate center of enclosure 112. As used herein the term "center of the enclosure" refers to the vertical position of the LEDs in the enclosure as being aligned with the approximate largest diameter area of the globe shaped main body 114. "Vertical" as used herein means along the longitudinal axis A-A of the lamp where the longitudinal axis extends from the base 102 to the distal end of the enclosure 112. In one embodiment, the LED array 128 is arranged in the approximate location that the visible glowing filament is disposed in a standard incandescent bulb. The terms "center of the enclosure" does not necessarily mean the exact center of the enclosure and is used to signify that the LEDs are located along the longitudinal axis of the lamp at a position between the ends of the enclosure near a central portion of the enclosure.

The electrical interconnect 150 comprises electrical conductors that form part of the electrical path connecting the LED assembly 130 to the lamp electronics 110. The interconnect 150 provides an electrical connection between the LED assembly 130 and the lamp electronics 110 that does not require bonding of the contacts from the lamp electronics 110 to the LED assembly 130. The electrical interconnect 150 comprises a first conductor for connecting to one of the anode or cathode side of the LED assembly 130 and a second conductor for connecting to the other one of the anode or cathode side of the LED assembly 130. The electrical interconnect 150 may be inserted into the cavity 174 of the heat sink 149 from the bottom of the heat sink 149 and moved toward the opposite end of the heat sink such that the finger 166 connects to the fixed member 168 in a snap-fit connection. When the electrical interconnect 150 is mounted to the heat sink 149 and the LED assembly 130 is mounted on the heat sink 149, an electrical path is created between the conductors of the electrical interconnect 150 and the LED assembly 130 and between the conductors of the electrical interconnect 150 and the lamp electronics board 80. These components are physically and electrically connected to one another and the electrical path between the lamp electronics 110 and the LEDs 127 is created.

In some embodiments, a driver and/or power supply may be included with the LED array 128 on the submount 129. In other embodiments the lamp electronics 110 such as the driver and/or power supply are mounted on electronics board 80 and may be located at least partially in cavity 174 in the heat sink 149 as shown for example in FIG. 4 where the size and shape of the heat sink may be configured to house the lamp electronics 110. The power supply and drivers may also be mounted separately where components of the power supply are mounted in the heat sink 149 and the driver is mounted with the submount 129 in the enclosure 112. The heat sink 149 may include a power supply or driver and form all or a portion of the electrical path between the mains and the LEDs 127. The heat sink 149 may also include only part of the power supply circuitry while some smaller components reside on the submount 129. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations, or a boost supply at lower voltages.

LED lighting systems according to embodiments of the present invention can work with a variety of different types of power supplies or drivers. For example, a transformer with a bridge rectifier, a buck converter, boost converter, buck-boost converter, or single ended primary inductor converter (SEPIC) circuit could all be used as a driver for an LED lighting system or solid-state lamp like that described herein. A SEPIC provides for universal input, wide output voltage range (30 to 150 V in some cases), good efficiency, non-isolation, and can be designed as a single stage for low-cost.

The base 102 may be connected to the heat sink 149 using a mounting plate 202 that is connected to the heat sink using fasteners such as screws or other connection mechanism. In one embodiment the base 102 is configured to fit into an existing light fixture such as an acorn or tear drop light. The base 102 of the lamp is designed to fit into existing lights and to occupy the space occupied by the screw receptacle in a traditional light. To install the lamp of the invention in an existing light fixture, the receptacle, such as the mogul receptacle, is removed from the light fixture. The wires that deliver critical current to the lamp are disconnected from the mogul receptacle and are used with the lamp of the invention to deliver current to the lamp of the invention. The base 102 of the lamp is inserted into the space vacated by the traditional mogul receptacle. The base 102 of the lamp is physically mounted in the light fixture and, in some embodiments, the base 102 includes a universal mounting plate 204 that allows it to be mounted to the existing mounting structure of the light. The electrical supply wires from the light fixture are connected to the base 102 of the lamp of the invention to deliver current to the LEDs 127 in the lamp 100.

Wires or other connectors 230 extend from the lamp electronics 110 into the base 102 for delivering current to the LED assembly 130. The wires 230 may be soldered to electronics board 80 and may extend from the interior of the heat sink 149 into the interior of the base 102. In one embodiment, the electrical path to the lamp electronics 110 includes a surge protector 232 for protecting the lamp electronics 110 in the event of a power surge such as a lightning strike. An electrical connector 234, such as a terminal block, may be used to facilitate connection of the wires in the lamp and to facilitate removal of the surge protector in the event of a power surge.

Figure 5:
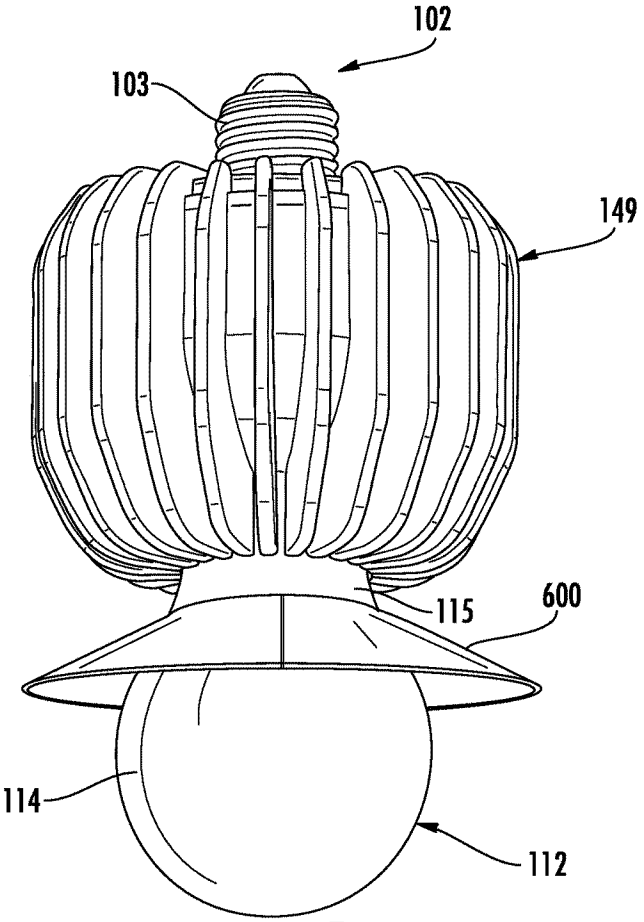
FIG. 5 is a perspective view of another embodiment of the lamp of the invention.

While in some embodiments the existing electrical receptacle, such as the mogul connector, may be removed from the light fixture, in other embodiments the lamp base 102 may be provided with a mating screw connector 103 such that the lamp may be screwed into the existing receptacle as shown in FIG. 5.

To provide a complete luminaire that may be used in an existing light, applicable safety standards may require that the lamp electronics be isolated to provide approved flame, impact and enclosure ratings. The base 102 may be enclosed using a cover 250 that is releasably secured to a casing 206 to isolate the exposed electrical components.

The lamp may be used in damp or dry listed locations. The lamp may produce between approximately 2500 and 4500 Lumens, and in some embodiments may produce approximately 3000-4000 Lumens, and in some embodiments the lamp may produce approximately 3500 Lumens. In some embodiments the LED assembly 130 may comprise approximately 40 XTE LEDs manufactured and sold by CREE INC. The lamp may have a color rendering index of greater than 70 and in some embodiments the CRI may be greater than 80 and in some embodiments the CRI may be about 83. The lamp may produce approximately 100 Lumens per Watt and in some embodiments may produce over 100 Lumens per Watt. The color temperature may be approximately 2800-3300 K and in one embodiment the color temperature may be approximately 3200 K and in other embodiments the color temperature may be approximately 2800-2900 K. It will be appreciated that the refractor lens or globe 600 may affect the Lumen output of the lamp. For example, the globe 600 may reduce the output of the lamp approximately 8-10 percent compared to a lamp operated without the globe. The size and shape of the heat sink 149 is selected to adequately cool the LEDs 127 such that the performance of the LEDs is not degraded over time and to fit into the light fixture with which the lamp is to be used.

Figure 6:
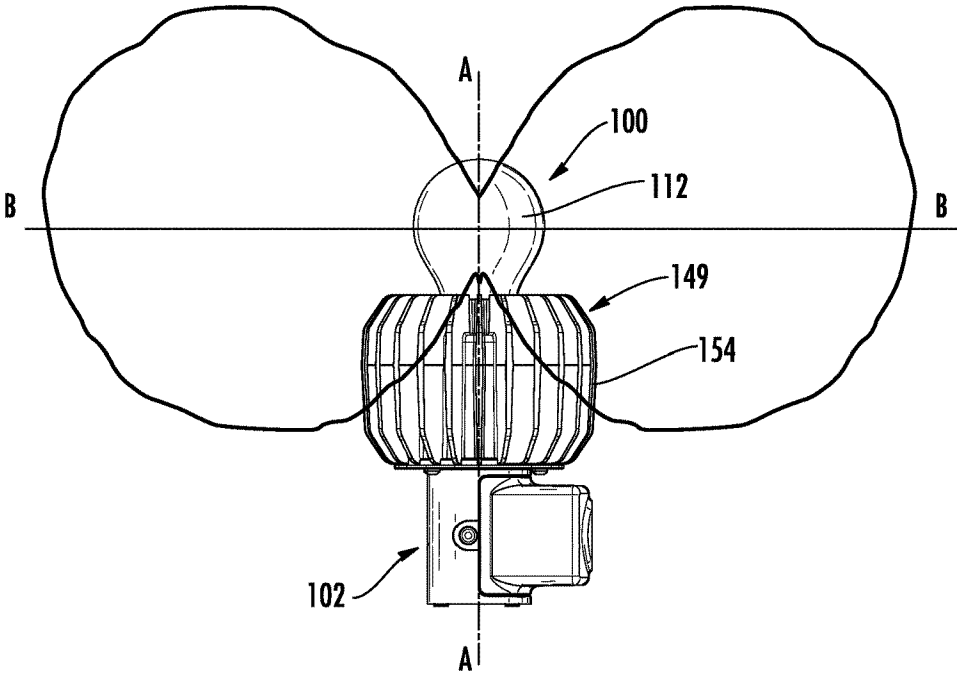
FIG. 6 is a side view of a lamp showing the light distribution pattern without a reflector.
Figure 9:
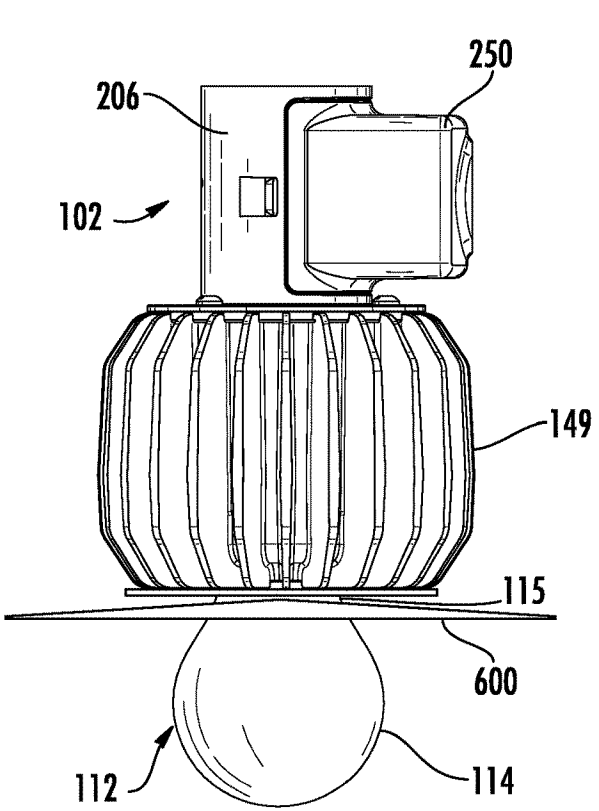
FIG. 9 is a side view of still another embodiment of the lamp of the invention.

The lamp as described herein is intended as a universal retrofit device for acorn and tear-drop style fixtures and as such is listed by UL as a wet location luminaire. The light as described herein may be used in base-up or base-down applications. Base-down applications are applications where the base is disposed beneath the enclosure 112 such as shown in FIGS. 1-4 and 7 and base-up applications are applications where the base is disposed above the enclosure 112 such as shown in FIGS. 5, 8 and 9. Because the lamp described herein is intended to be used in both base-up and base-down applications, a bulb based design is used where the light distribution is substantially omnidirectional where the light emitted as uplight is approximately equal to the light emitted as downlight. Referring to FIG. 6 in one embodiment the uplight is approximately 53.2% of the total light output of the lamp and downlight is approximately 46.8% of the total light output of the lamp. The plane dividing uplight from down light is essentially a plane oriented 90° from the vertical axis A-A and located at the approximate center of the enclosure 112 as represented by line B-B. In a base down orientation of the lamp, downlight is light emitted between line B-B and the base 102 and uplight is light emitted between line B-B and the distal end of the enclosure 112. While a specific light distribution pattern is shown and described, the light pattern may vary from that described for lamps that are still considered omnidirectional.

In some embodiments it may be desirable to provide a lamp where the light distributed as uplight is not substantially equal to the light emitted as downlight. For example, the DesignLights Consortium™ (DLC) requires certain light distribution patterns to qualify for rebates. The DLC is a project of Northeast Energy Efficiency Partnerships (NEEP), which promotes energy efficient commercial sector lighting.

In order to qualify for DLC rebates a lamp intended for acorn and teardrop fixtures must provide 65% downlight without reliance on the external fixture. In other applications the need for a non-symmetrical light distribution pattern may be driven by other mandatory or voluntary industry organizations, customer requirements, or application specific specifications. In such an embodiment downlight is light directed toward the ground and uplight is light directed away from the ground regardless of the orientation of the lamp.

Figure 14:
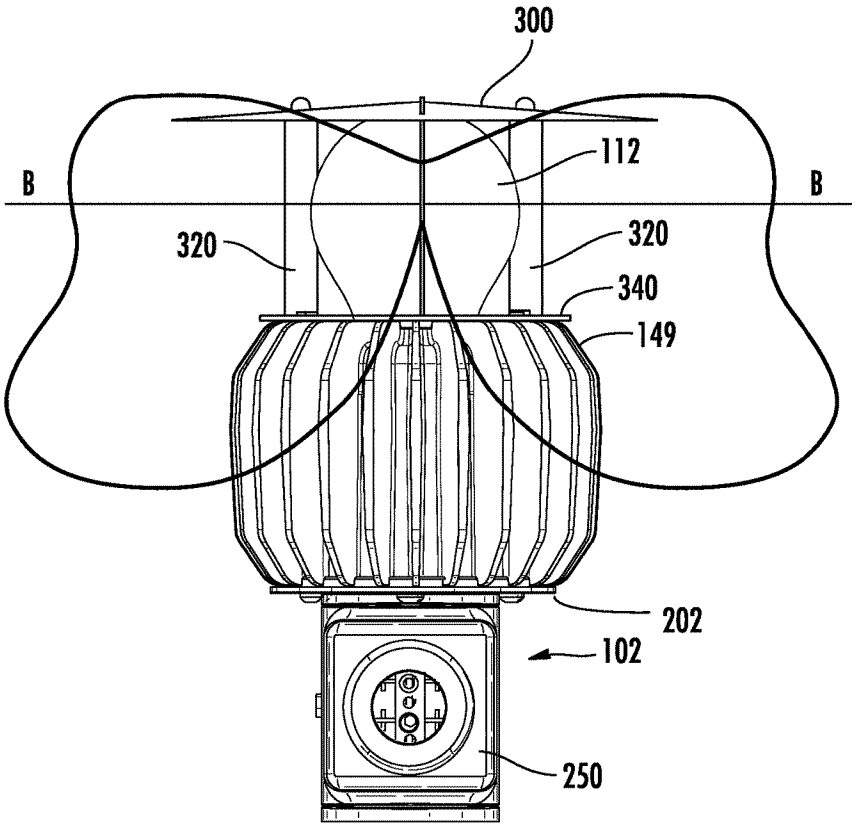
FIG. 14 is a side view of an embodiment of the lamp of the invention showing the light distribution pattern.

In order to provide a desired directional light distribution pattern the lamp is provided with a reflector that forms part of the lamp and that shapes the light distribution to provide the required non-symmetrical output. In one embodiment, a reflector is used with the omnidirectional lamp described herein to provide at least 65% downlight as shown in FIG. 14. In one embodiment the lamp emits approximately 75% downlight although that percentage may be altered based on the size, shape and construction of the reflector. The reflector may be used in base-up and base-down embodiments to provide the necessary downlight. In base-up embodiments, the downlight is actually light directed toward the distal end of the lamp, away from the base 102, because the lamp is installed in an upside down orientation. Using a reflector as described herein the same lamp may be used in both embodiments thereby simplifying manufacturing considerations and lowering costs.

Figure 4:
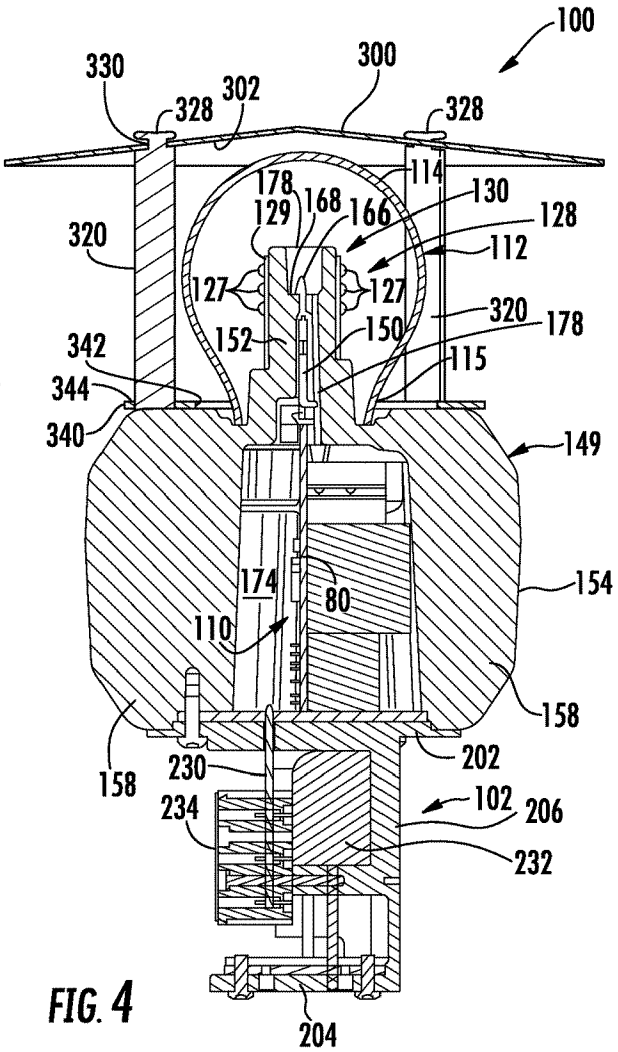
FIG. 4 is a section view of the lamp of FIG. 1.
Figure 3:
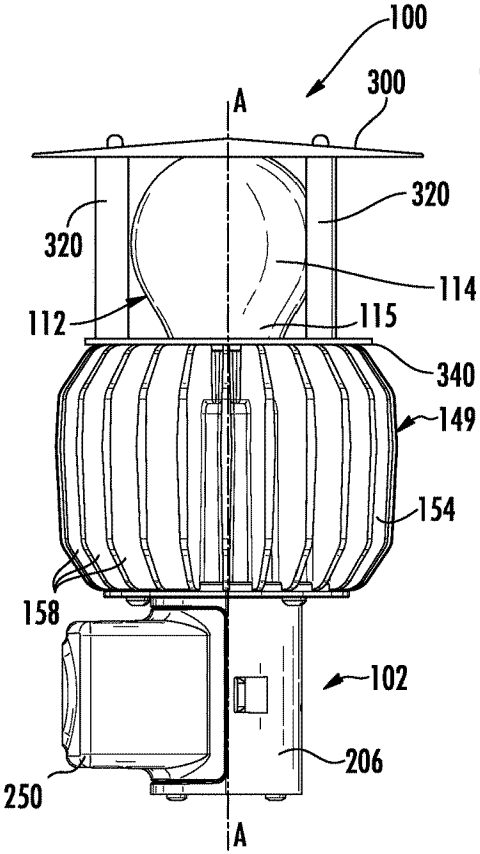
FIG. 3 is a side view of the lamp of FIG. 2.
Figure 2:
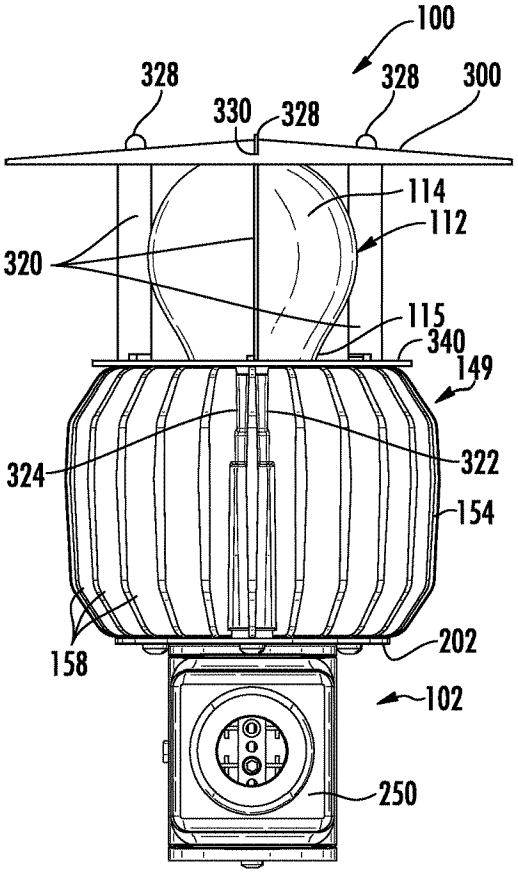
FIG. 2 is a front view of an embodiment of the lamp of the invention.
Figure 10:
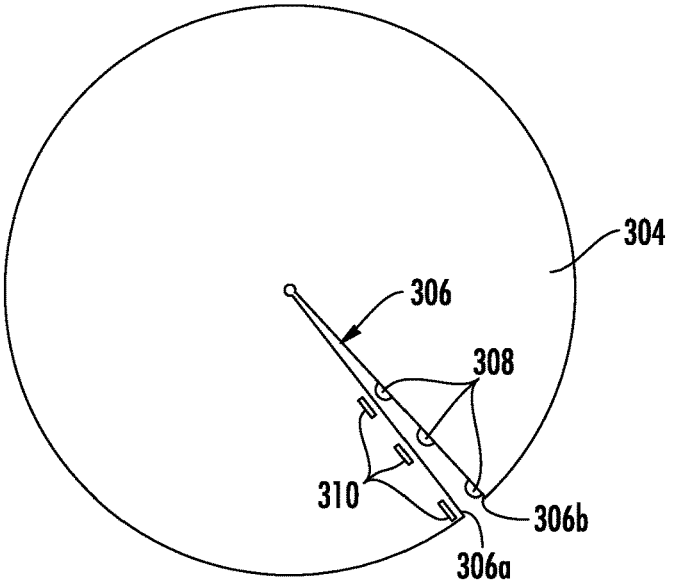
FIGS. 10-13 are plan views of different embodiments of the reflector used in the lamp of the invention.

Referring to FIGS. 2-4, one base-down embodiment is illustrated where the lamp is intended to be installed with the base 102 below the enclosure 112. A reflector assembly comprises a reflector 300 mounted over the enclosure 112 and having a reflective surface 302 facing the base 102. In a typical embodiment the reflector has a thin walled construction such that the shape of the reflective surface 302 and the shape of the reflector 300 are substantially the same. For example, in the embodiment of FIGS. 2-4 the reflector 300 has a generally shallow cone shape where the reflective surface 302 has a corresponding shallow cone shape. However, the exterior shape of the reflector 300 may be different than the shape of the reflective surface 302. As described herein the shape of the reflector refers to the shape of the reflective surface 302 and for a thin walled member is generally the same as the overall shape of the reflector. The reflector 300 may comprise a variety of shapes and sizes provided that light reflecting off of the reflector 300 is reflected generally along the axis A-A of the lamp as downlight. The reflector 300 may, for example, be conical, parabolic, hemispherical, faceted or the like. In one embodiment the reflector is a conical reflector formed by a circular flat member 304, shown in FIG. 10 having a slit 306 formed between the center of the flat member 304 and the peripheral edge of the member. The member may be made of thin aluminum. The slit may be generally triangular shaped such that when the edges 306*a*, 306*b* of the slit 306 are brought together the flat member 304 is bent into the conical reflector 300. The edges 306*a*, 306*b* of the slit may be maintained in abutting relationship by any suitable fastener including welding, adhesive separate fasteners or the like. In the illustrated embodiment one edge 306*b* comprises tabs 308 that are inserted into slots 310 formed adjacent the opposite edge 306*a*. The tabs 308 may be bent or deformed to secure the tabs 308 in the slots 310. In other embodiments an aluminum reflector may be formed by a stamping process. In other embodiments the reflector may be formed as a molded plastic piece.

In some embodiments, the reflector 300 may be a diffuse or Lambertian reflector and may be made of a highly reflective material such as aluminum injection molded plastic, white optics, PET, MCPET, or other reflective materials. The reflector 300 may reflect light but also allow some light to pass through it. The reflector 300 may also be made of a specular material. The specular reflectors may be injection molded plastic or metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet.

The reflector 300 is mounted on the lamp such that it extends over the enclosure 112 and reflects some of the light generated by the LED assembly 130. The reflector 300 may be mounted on the lamp using a variety of connection mechanisms. In one embodiment, the reflector 300 is mounted to the heat sink 149 as an assembly comprising a plurality of uprights 320 that extend from the heat sink 149 to a point adjacent to or above the end of the enclosure 112. The uprights 320 may comprise relatively narrow plates as shown, rods or other similar support members. In one embodiment the uprights 320 are made relatively thin to block as little light emitted from the lamp as possible. In some embodiments the uprights 320 may be made of a resilient, deformable material such as aluminum having sufficient structural strength to support the reflector 300 in position. The uprights 320 may be secured to the fins 158 of the heat sink 149 using a deformable clamp such that the uprights may be secured to the heat sink without using additional fasteners, materials, tools or the like. The ends of the uprights are formed with a pair of opposed flanges 322, 324 that defines a space therebetween. The space is dimensioned to receive the top edge of a fin 158 such that the fin 158 is trapped between the opposed flanges 322, 324. In one embodiment the space between the opposed flanges 322, 324 is slightly narrower than the thickness of the fin 158 such that the flanges 322, 324 are deformed slightly away from one another when the fin 158 is inserted between the flanges. The deformation of the resilient flanges 322, 324 creates a clamping force on the fin 158 that secures the uprights 322 to the fins 158. As shown, three uprights 320 are used to support the reflector 300; however, a greater or fewer number of uprights may be used. The distal ends of the uprights 320 may comprise tabs 328 that are inserted into slots 330 formed in the reflector 300. The tabs 328 may be bent or deformed (see FIG. 4) to secure the tabs in the slots 330. In some embodiments, the uprights 320 may comprise a reflective member and may be made of a highly reflective material as previously described.

A base plate 340 may be secured to the proximate ends of the uprights 320 adjacent to the heat sink 149. The base plate 340 supports and positions the ends of the uprights 320 such that the uprights are properly aligned relative to the fins 158 and are supported during attachment of the uprights 320 to the fins 159. In one embodiment the base 340 has an annular shape such that the internal opening 342 of the base plate 340 fits over the enclosure 112 such that the reflector assembly may be secured to the heat sink 149 over the enclosure 112. The uprights 320 are spaced and dimensioned such that the uprights are positioned to the outside of the enclosure 112 with the enclosure 112 fitting within the space defined by the uprights. In one embodiment the uprights 320 are permanently secured to the base plate 340 such that the base plate 340 and the uprights 320 are installed over the enclosure 112 as a unit. In one embodiment the base plate 340 comprises slots 344 that receive the proximal ends of the uprights 320 such that the uprights may be inserted into the slots during assembly of the base plate to the reflector assembly. After the uprights 320 are inserted into the slots 344 in the base plate 340, the reflector 300 is secured to the distal ends of the uprights 320 as previously described. In some embodiments the base plate 340 may be eliminated and the uprights 320 may be connected to the heat sink 149 individually. The uprights 320 may also be secured to the base plate 340 using a welded connection, separate fasteners, adhesive, friction fit, mechanical engagement such as a snap-fit connection, or the like.

The uprights 320 support the reflector 300 adjacent the distal end of the enclosure 112. The reflector 300 is sized and shaped to reflect as much light as necessary to achieve the desired light distribution pattern. In at least some embodiments, the reflector is wider than the enclosure 112 and the heat sink 149.

The reflector assembly may be dimensioned such that the enclosure 112 may be inserted through the opening 342 in the base plate 340 and fit between the uprights 320. As previously explained, the reflector 300 may be positioned such that it reflects some of the light generated by the LED assembly 130. However, at least a portion of the light generated by the LED assembly 130 may not be reflected by the reflector 300. At least some of this may be projected as uplight directly out of the enclosure without being reflected by the reflector.

Figure 7:
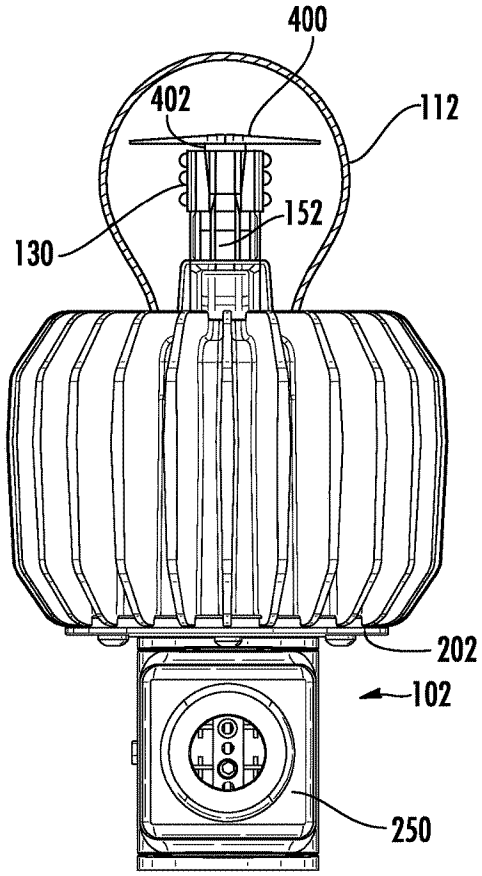
FIG. 7 is a partial section view of another embodiment of the lamp of the invention.
Figure 8:
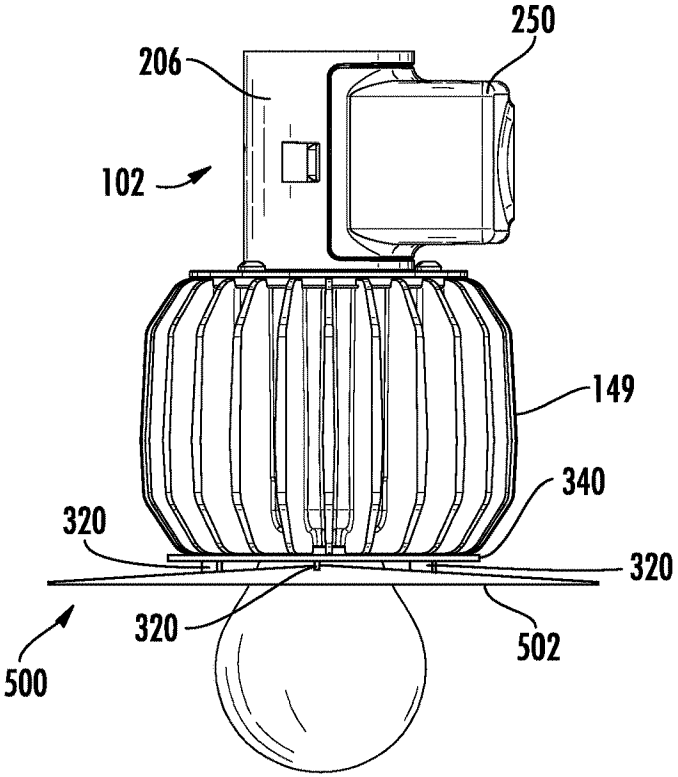
FIG. 8 is a side view of yet another embodiment of the lamp of the invention.

Another embodiment of the lamp is shown in FIG. 7 where a reflector 400 is positioned inside of the enclosure 112 to reflect light from the LED assembly as downlight. In the embodiment of FIG. 7 the reflector 400 is internal to the enclosure 112 such that the reflector 400 is installed in the manufactured lamp. Unlike the embodiment of FIGS. 1-4 where the reflector may be added to the lamp as a retrofit option, in the embodiment of FIG. 7 the reflector 400 is installed inside of enclosure 112 during the manufacturing process of the lamp. As explained above, the reflector 400 may comprise a variety of shapes and sizes provided that light reflecting off of the reflector 400 is reflected generally along the longitudinal axis of the lamp as downlight. The reflector 400 may, for example, be conical, parabolic, hemispherical, faceted or the like. The reflector may be made of aluminum. In some embodiments, the reflector may be a diffuse or Lambertian reflector and may be made of a white highly reflective material such as injection molded plastic, white optics, PET, MCPET, or other reflective materials. The reflector may reflect light but also allow some light to pass through it. The reflector 400 may be made of a specular material. The specular reflectors may be injection molded plastic or metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet.

The reflector may be secured to the internal structure of the lamp. For example, the reflector may be mounted to the tower 152 or to the LED assembly 130. In one embodiment the reflector may be mounted to the tower 152 by a support member 402 that engages the tower 152. The support member 402 may be secured to the tower using a deformable tines that engage the inside surface of recess 171 (FIG. 4) formed in the top of tower 152. In some embodiments the support member 402 may be made of a resilient, deformable material such as aluminum having sufficient structural strength to support the reflector in position. The support member 402 may comprise tines that may be deformed inwardly and inserted into the recess 171 such that the resiliency of the material of the support member biases the tines against the interior surface of the tower 152. The support member may also comprise a deformable plastic member that is force fit into the recess 171. In other embodiments the support member may be mounted to the heat sink 149 using a welded joint, separate fasteners, adhesive, friction fit, mechanical engagement such as a snap-fit connection, or the like. In one embodiment, the snap-fit connector may comprise a deformable, resilient tang on one of the support member 404 or the tower 152 that is received in a mating receptacle on the other of the support member or tower. The tangs may be inserted into the receptacles such that locking surfaces on the tangs engage the receptacles. In some embodiments, the support member may comprise a reflective member and may be made of a highly reflective material as previously described.

Embodiments of the lamp where the lamp is in a base-up orientation are shown in FIGS. 5, 8 and 9 where the reflector is positioned to reflect light from the LED assembly as downlight (i.e. light reflected toward the ground) along the axis A-A of the lamp away from the base 102 and toward the distal end of the enclosure 112. Referring to FIG. 8 reflector assembly 500 comprises a reflector 502 mounted over the enclosure 112 and having a reflective surface facing away from the base 102. The reflector 502 may comprise a variety of shapes and sizes provided that light reflecting off of the reflector 502 is reflected generally along the longitudinal axis of the lamp as downlight. The reflective surface may, for example, be conical, parabolic, hemispherical, faceted or the like. In some embodiments, the reflector may be a diffuse or Lambertian reflector and may be made of a white highly reflective material such as injection molded plastic, white optics, PET, MCPET, or other reflective materials. The reflector may reflect light but also allow some light to pass through it. The reflector 500 may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet.

In some embodiments the reflector 500 may be attached to the heat sink 149 in the same manner as in the embodiment of FIGS. 1 through 6. Referring to FIG. 8 in one embodiment, the reflector 500 is mounted on the heat sink 149 using the uprights 320 connected to the fins 158 of heat sink 149 and a base plate 340 as previously described. The reflector 500 is formed as an annular member having a central aperture that receives the neck portion 115 of the enclosure 112 such that the enclosure 112 may extend through the reflector 500. The uprights 320 are shorter than the uprights used in the embodiment of FIGS. 1-6 such that the reflector 500 may be disposed between the heat sink 149 and the main portion 114 of the enclosure 112 rather beyond the distal end of enclosure 112 as was the case with the embodiment of FIGS. 1-6.

In the embodiment of FIGS. 5 and 9 the reflector 600 is supported on the enclosure 112, rather than on separate uprights, such that the reflector 600 is suspended from the enclosure 112. The reflector 600 is formed as an annular member having a central aperture that receives the neck portion 115 of the enclosure 112 such that the enclosure 112 may extend through the reflector 600. The aperture is dimensioned such that the enclosure 112 cannot fit through the aperture. In this manner when the lamp is oriented in the illustrated base-up configuration the portion of the reflector 600 surrounding the aperture rests on and is supported directly by the enclosure 112.

Figure 13:
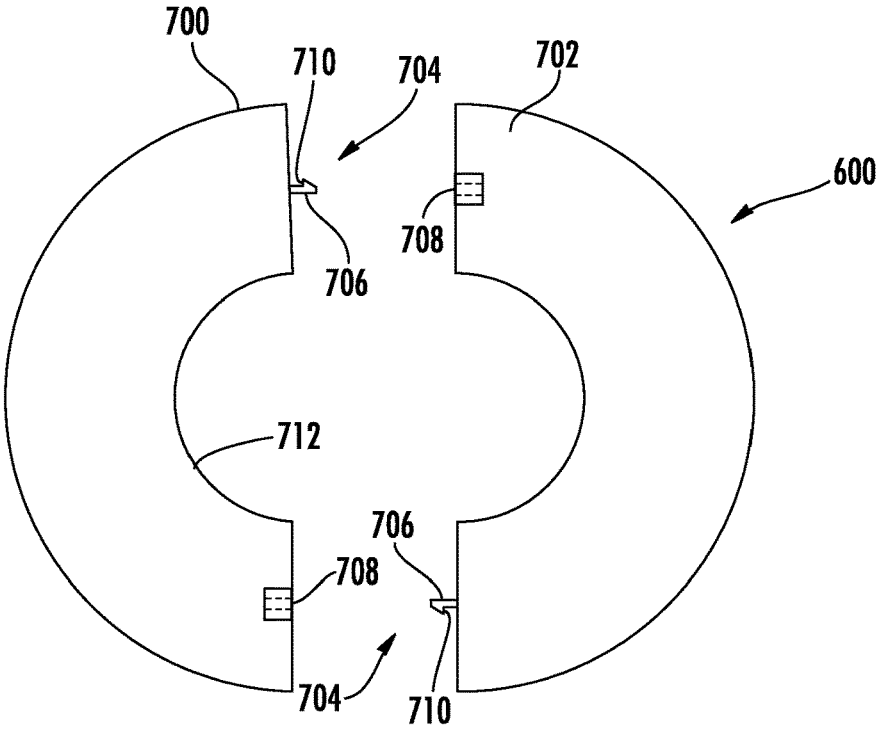

Referring to FIG. 13, in the embodiments of FIGS. 8 and 9, the reflector may be made in two portions 700 and 702 that together surround the enclosure 112 and connect to one another using snap fit connectors 704 to clamp the neck of the enclosure therebetween in central aperture 712. In the illustrated embodiment the two portions 700, 702 may be identical such that a single component may be used as both parts although the two portions may be different. The snap fit connectors 704 may comprise a deformable, resilient tang 706 on one reflector portion that is received in a mating receptacle 708 on the other reflector portion where each reflector portion comprises one tang and one receptacle. However, two tangs may be formed on one portion and two receptacles may be formed on the other portion. The tangs 706 may be inserted into the receptacles 708 such that locking surfaces 710 on the tangs 706 are disposed behind, or otherwise engage, the receptacles 708. The structure of the reflector described above may be used with any of the embodiments of the reflector and in any of the lamps described herein.

Figure 11:
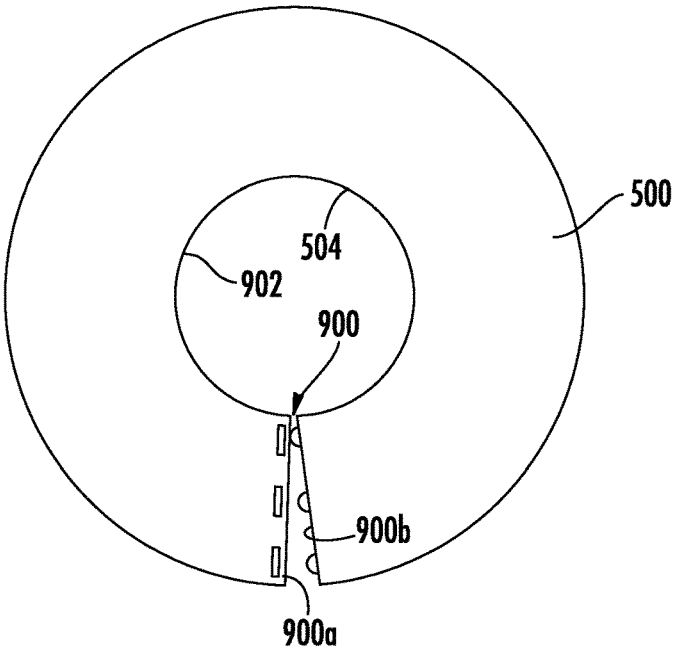
Figure 12:
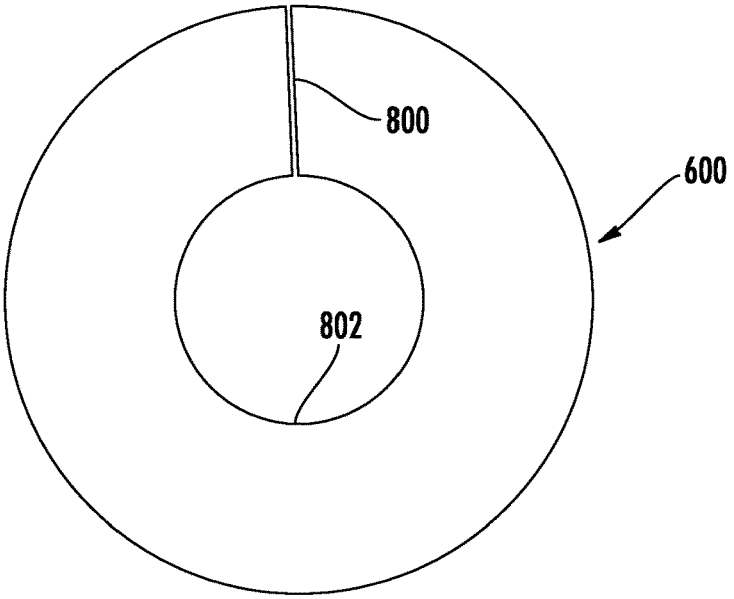

In another embodiment the reflector may be made of a deformable resilient material such as plastic or metal where a slit 800 is formed in the reflector from the inner aperture 802 to the outside edge of the reflector as shown in FIG. 12 such that the reflector may be deformed to expand the split such that the neck 115 of the enclosure 112 may be inserted through the slit 800 and the enclosure 112 located in the central aperture 802. When the reflector is released the material of the reflector returns the reflector to the undeformed shape such that the slit 800 closes and the reflector is a substantially uninterrupted surface. In another embodiment, as shown in FIG. 11, a triangular slot 900 may be formed between aperture 902 and the outside edge of the reflector. The edges 900*a*, 900*b* of the slot 900 may be connected together as previously described with respect to FIG. 10 to form the conical reflector. In another embodiment the reflector may be made of a relatively deformable material such as a thin aluminum or white plastic that allows the reflector to be deformed and the central aperture to be forced over the body portion 114 of enclosure 112.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp having an exterior and an interior comprising:

an at least partially optically transmissive enclosure defining an exit surface through which light is emitted from the lamp, the optically transmissive enclosure separating the interior of the lamp from the exterior of the lamp;

a LED assembly comprising at least one LED, the LED assembly being located in the enclosure and the at least one LED operable to emit light when energized through an electrical path;

a heat sink for dissipating heat from the LED assembly, the heat sink being connected to the enclosure such that the lamp has a longitudinal axis that extends from the heat sink to the enclosure;

a base connected to the heat sink, the base comprising an electrical connector for connecting to an electrical supply, the electrical connector being in the electrical path;

a reflector secured to the heat sink such that the reflector is positioned outside of and extends laterally beyond the enclosure and to a side of the enclosure opposite to the heat sink and reflects light along the longitudinal axis of the lamp;

wherein the enclosure, heat sink, base and reflector may be mounted in a fixture as an assembled lamp.

2. The lamp of claim 1 wherein the reflector is mounted over the enclosure and has a reflective surface facing the heat sink.

3. The lamp of claim 1 wherein the reflector is conical.

4. The lamp of claim 1 wherein the reflector is made of thin aluminum.

5. The lamp of claim 1 wherein the reflector is made of plastic.

6. The lamp of claim 1 wherein the reflector is mounted on the heat sink using an upright.

7. The lamp of claim 6 further comprising a plurality of uprights, and a base plate secured to each of the plurality of uprights.

8. The lamp of claim 7 wherein the base plate has an annular shape defining an internal opening where the internal opening fits over the enclosure.

9. A light comprising:

an at least partially optically transmissive fixture;

a LED lamp disposed in the fixture, the LED lamp comprising:

an at least partially optically transmissive enclosure at least partially defining an interior of the lamp and an exterior of the LED lamp;

a LED assembly comprising at least one LED, the LED assembly being located in the enclosure and the at least one LED operable to emit light when energized through an electrical path;

a heat sink for dissipating heat from the LED assembly, the heat sink being connected to the enclosure such that the lamp has a longitudinal axis that extends from the heat sink to the enclosure;

a base in the electrical path;

a reflector secured to the heat sink by an upright, the upright connected to the reflector and the heat sink such that the reflector is positioned outside of the enclosure and to a side of the enclosure opposite to the heat sink and reflects light along the longitudinal axis of the lamp, the reflector being wider than the enclosure.

10. The light of claim 9 wherein the LED lamp is mounted in the fixture with the base above the enclosure.

11. The light of claim 9 wherein the LED lamp is mounted in the fixture with the base below the enclosure.

12. A lamp comprising:

an at least partially optically transmissive enclosure;

a LED assembly comprising at least one LED, the LED assembly being located in the enclosure and the at least one LED operable to emit light when energized through an electrical path;

a heat sink for dissipating heat from the LED assembly, the heat sink being connected to the enclosure such that the lamp has a longitudinal axis that extends from the heat sink to the enclosure;

a reflector mounted to the heat sink such that the reflector reflects light along the longitudinal axis of the lamp, the reflector being mounted to the heat sink using an upright where the upright is secured to the heat sink using a deformable clamp.

13. The lamp of claim 12 wherein the deformable clamp comprises a pair of opposed flanges that define a space therebetween, the space dimensioned to receive a fin of the heat sink.

14. The lamp of claim 13 wherein the space between the opposed flanges is slightly narrower than a thickness of the fin such that the flanges are deformed slightly away from one another when the fin is inserted between the flanges to create a clamping force on the fin.

15. A lamp comprising:

an at least partially optically transmissive enclosure;

a LED assembly comprising at least one LED, the LED assembly being located in the enclosure and the at least one LED operable to emit light when energized through an electrical path;

a heat sink for dissipating heat from the LED assembly, the heat sink being connected to the enclosure such that the lamp has a longitudinal axis that extends from the heat sink to the enclosure;

a conical reflector secured to the heat sink such that the reflector reflects light along the longitudinal axis of the lamp, the conical reflector being formed by a flat member having a slit formed between the center of the flat member and the peripheral edge of the member.

16. The lamp of claim 15 wherein the slit is generally triangular shaped defined by a first side edge and a second side edge, the first side edge and the second side edge being connected together to form the conical reflector.

17. A lamp having an exterior and an interior comprising:

an at least partially optically transmissive enclosure defining an exit surface through which light is emitted from the lamp, the optically transmissive enclosure separating the interior of the lamp from the exterior of the lamp;

a LED assembly comprising at least one LED, the LED assembly being located in the enclosure and the at least one LED operable to emit light when energized through an electrical path to produce between approximately 2500 and 4500 Lumens;

a heat sink comprising a heat dissipating portion that is exposed to the exterior of the lamp for dissipating heat from the LED assembly, the heat sink being connected to the enclosure such that the lamp has a longitudinal axis that extends from the heat sink to the enclosure;

a reflector secured to the exposed heat dissipating portion such that the reflector is positioned entirely outside of the enclosure and to a side of the enclosure opposite to the heat sink and reflects light downwardly along the longitudinal axis of the lamp.

18. A light assembly comprising:

a LED lamp configured to be mounted in a fixture in both a base up orientation and a base down orientation, the LED lamp comprising:

an at least partially optically transmissive enclosure comprising a distal end;

a LED assembly comprising at least one LED, the LED assembly being located in the enclosure and the at least one LED operable to emit light when energized through an electrical path;

a heat sink for dissipating heat from the LED assembly, a first end of the heat sink being connected to the enclosure such that the lamp has a longitudinal axis that extends from the heat sink to the enclosure the heat sink being spaced from the distal end along the longitudinal axis;

a base connected to the heat sink, the base comprising an electrical connector for connecting to an electrical supply, the electrical connector being in the electrical path;

in the base-up orientation a first reflector is secured to the LED lamp remote from the distal end to reflect light downwardly along the longitudinal axis of the LED lamp and away from the base, the first reflector being positioned entirely outside of the enclosure; and in the base-down orientation a second reflector is secured to the LED lamp adjacent the distal end to reflect light downwardly along the longitudinal axis of the LED lamp and toward the base, the second reflector being secured to the heat sink such that the second reflector extends laterally beyond the enclosure and to a side of the enclosure opposite to the heat sink and reflects light along the longitudinal axis of the lamp, the second reflector being positioned entirely outside of the enclosure.

* * * * *